US007888298B2

(12) United States Patent
Poirier et al.

(10) Patent No.: US 7,888,298 B2
(45) Date of Patent: Feb. 15, 2011

(54) LUBRICANT COMPOSITIONS WITH IMPROVED PROPERTIES

(75) Inventors: Marc-Andre Poirier, Cherry Hill, NJ (US); Kevin L. Crouthamel, Richboro, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1001 days.

(21) Appl. No.: 11/725,773

(22) Filed: Mar. 20, 2007

(65) Prior Publication Data

US 2008/0234156 A1 Sep. 25, 2008

(51) Int. Cl.
*C10M 105/36* (2006.01)

(52) U.S. Cl. ..... 508/496; 508/363

(58) Field of Classification Search ..... 508/363, 508/496

See application file for complete search history.

(56) References Cited

U.S. PATENT DOCUMENTS

| | | | | |
|---|---|---|---|---|
| 3,157,600 | A * | 11/1964 | Matson | 508/484 |
| 4,321,153 | A | 3/1982 | Recchuite | |
| 4,707,301 | A | 11/1987 | Lange | |
| 4,839,068 | A | 6/1989 | Lange | |
| 4,960,542 | A | 10/1990 | Seiki | |
| 4,968,452 | A | 11/1990 | Seiki | |
| 5,422,023 | A | 6/1995 | Francisco | |
| 5,665,686 | A | 9/1997 | Schlosberg et al. | |
| 6,573,224 | B2 | 6/2003 | McNeil et al. | |
| 2007/0093398 | A1 * | 4/2007 | Habeeb et al. | 508/485 |

FOREIGN PATENT DOCUMENTS

| | | | |
|---|---|---|---|
| EP | 0 690 901 | B1 | 12/1998 |
| EP | 690901 | B1 * | 12/1998 |
| WO | WO 2005/097956 | A1 | 10/2005 |

OTHER PUBLICATIONS

Tanchuk, Yu V., et al., "Synthesis of maleic anhydride/ .alpha.-olefin copolymers and products of their chemical modification by reaction with alcohols", Neftepererabotka i Neftekhimiya (Kiev) (1984), 27, 23-6.

* cited by examiner

*Primary Examiner*—Glenn Caldarola
*Assistant Examiner*—Jim Goloboy
(74) *Attorney, Agent, or Firm*—Liza Montalvo; Joseph J. Dvorak

(57) ABSTRACT

A lubricant composition for providing friction reducing properties and VI and solvency improving properties in a lubricant system is disclosed. The lubricant composition comprises a major amount of at least one base oil and an effective amount of a high viscosity polyester additive having a kinematic viscosity at 100° C. of at least about 2,500 $mm^2/s$.

13 Claims, No Drawings

LUBRICANT COMPOSITIONS WITH IMPROVED PROPERTIES

FIELD OF THE INVENTION

This invention relates to lubricant compositions. More particularly, this invention relates to lubricant compositions having reduced friction coefficient, improved viscosity index and improved solvency.

BACKGROUND OF THE INVENTION

Improving frictional properties in lubricant composition has been an objective of the industry. Friction between two surfaces will increase the power required to effect movement and where the movement is an integral part of an energy conversion system, it is most desirable to effect lubrication in a manner which will minimize this friction. By minimizing friction in a lubricant system, fuel economy and energy efficiency are maximized. Friction modifiers have been used to promote such friction-reducing properties in lubricant systems.

Friction modifiers are well-known in the art and are currently used in engine oil formulations. Friction modifiers know in the art include glycerol mono-, di- and tri-oleate and mixtures thereof, oleylamide, ethoxylated amines such as Duomeen® TDO, alkyl dithiocarbamates, molybdenum dialkyldithiocarbamates, trinuclear organomolybdenum compounds.

Friction modifiers are not commonly known to improve the viscosity index (VI) of a lubricant. Generally, VI improvers are olefin polymers such as polyisobutylene, ethylene propylene copolymers, hydrogenated polymers and copolymers and terpolymers of styrene with isoprene and/or butadiene, polymers of alkyl acrylates or alkyl methacrylates, copolymers of alkylmethacrylates with N-vinylpyrrolidone or dimethylaminoalkyl methacrylate, post grafted polymers of ethylene-propylene with an active monomer such as maleic anhydride which may be further reacted with an alcohol or an alkylene polyamine, styrene-maleic anhydride polymers post reacted with alcohols and amines and the like. These materials function by increasing the viscosity of the base oil proportionately more at high temperatures than at low temperatures. VI improvers are a well-known separate class of additives than the friction modifiers. Most, if not all engine lubricant compositions, are formulated with both VI improvers and friction modifiers.

In the prior art, many friction modifier additives have been suggested and used. For example, U.S. Pat. No. 4,839,068 is directed to polyesters in lubricant compositions that act as friction reducers, viscosity improvers and film-forming enhancers. The lubricant composition comprises mineral oil and at least one polysuccinate ester wherein the succinate group contain alkyl or alkenyl substituents.

U.S. Pat. No. 4,683,069 relates to lubricant oil compositions exhibiting improved fuel economy which contain 0.05 to 0.2 wt % of a glycerol partial ester of a $C_{16}$-$C_{18}$ fatty acid as the fuel economy additive.

U.S. Pat. No. 4,707,301 is directed to lubricant additives that improve friction modifying properties in functional fluids. The lubricant additives comprise dimer ester and polyester materials derived from adducts of O, O-dialkyl dithiophosphoric acids and 5-norbornene-2,3-dicarboxylic anhydride.

EP 0259808 is directed to lubricating oil compositions exhibiting good frictional characteristics, where the composition comprises a mineral oil and polyester, which includes hindered esters and dicarboxylic acid esters.

EP 0815186 is directed to polyolester compositions, which exhibit lower friction coefficient when compared to conventional synthetic esters, having unconverted hydroxyl groups.

Despite the advances in lubricant oil formulation technology, there remains a need for an additive that will effectively reduce the friction coefficient of oil based lubricants and additionally improve VI and solvency in said lubricants.

SUMMARY OF THE INVENTION

In accordance with a first aspect of the invention, there is provided additives useful for reducing the friction coefficient in lubricant compositions. In a further aspect of the invention, there is provided additives useful for improving the VI in lubricant compositions. In still another aspect of the invention, there is provided additives useful for improving the solvency of lubricant compositions.

In another aspect of the invention, there is provided a lubricant composition containing the additives of the present invention having a reduced friction coefficient, improved VI and improved solvency.

Other objects and advantages of the present invention will become apparent from the detailed description that follows.

It has now been found that lubricating compositions comprising a major amount of at least one base oil and an effective amount of a high viscosity polyester additive having a kinematic viscosity at 100° C. of at least about 2,500 $mm^2/s$ provide friction reducing properties and VI and solvency improving properties in lubricant systems.

DETAILED DESCRIPTION

Lubricant compositions comprise a major amount of base oil. A wide range of lubricating base oils is known in the art. Lubricating base oils that are useful in the present invention are synthetic oils and unconventional oils of lubricating viscosity, typically those oils having a kinematic viscosity at 100° C. in the range of 2 to 100 mm2/s, preferably 2 to 50 mm2/s, more preferably about 4 to 25 mm2/s.

Groups I, II, III, IV and V are broad categories of base stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III base stocks generally have a viscosity index of greater than about 120 and contain less than or equal to about 0.03% sulfur and greater than about 90% saturates. Group IV base stocks include polyalphaolefins (PAO). Group V base stocks include base stocks not included in Groups I-IV. The following table summarizes properties of each of these five groups.

TABLE A

| Base Stock Properties | | | |
|---|---|---|---|
| | Saturates | Sulfur | Viscosity Index |
| Group I | <90% and/or | >0.03% and | ≧80 and <120 |
| Group II | ≧90% and | ≦0.03% and | ≧80 and <120 |
| Group III | ≧90% and | ≦0.03% and | ≧120 |

TABLE A-continued

| Base Stock Properties | | | |
|---|---|---|---|
| | Saturates | Sulfur | Viscosity Index |
| Group IV | Polyalphaolefins (PAO) | | |
| Group IV | All other base stocks not included in Groups I, II, III or IV | | |

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example).

PAO base stocks are commonly used as synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are herein incorporated by reference.

The number average molecular weights of the PAOs, which are known materials and generally available on a major commercial scale from suppliers such as ExxonMobil Chemical Company, Chevron Phillips Chemical Company, BP, and others, typically vary in viscosity from about 250 to about 3,000 $mm^2/s$ (100° C.), although PAO's may be made in viscosities up to about 100 $mm^2/s$ (100° C.). The PAOs are typically comprised of relatively low molecular weight hydrogenated polymers or oligomers of alphaolefins which include, but are not limited to, $C_2$ to about $C_{32}$ alphaolefins with the $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting oligomer, the PAOs may be predominantly trimers and tetramers of the starting olefins, with minor amounts of the higher oligomers, having a viscosity range of 1.5 to 12 $mm^2/s$.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487, which are herein incorporated by reference. The dimers of the $C_{14}$ to $C_{18}$ olefins are described in U.S. Pat. No. 4,218,330.

Unconventional base stocks include one or more of a mixture of base stock(s) derived from one or more Gas-to-Liquids (GTL) materials. GTL base oil comprise base stock(s) obtained from a GTL process via one or more synthesis, combination, transformation, rearrangement, and/or degradation deconstructive process from gaseous carbon containing compounds. Preferably, the GTL base stocks are derived from the Fischer-Trospch (FT) synthesis process wherein a synthesis gas comprising a mixture of $H_2$ and CO is catalytically converted to lower boiling materials by hydroisomerisation and/or dewaxing. The process is described, for example, in U.S. Pat. Nos. 5,348,982 and 5,545,674, and suitable catalysts in U.S. Pat. No. 4,568,663, each of which is incorporated herein by reference.

GTL base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$. The GTL base stock and/or other hydrodewaxed, or hydroisomerized/cat (or solvent) dewaxed wax derived base stock(s) used typically in the present invention have kinematic viscosities in the range of about 3.5 $mm^2/s$ to 7 $mm^2/s$, preferably about 4 $mm^2/s$ to about 7 $mm^2/s$, more preferably about 4.5 $mm^2/s$ to 6.5 $mm^2/s$ at 100° C. Reference herein to kinematic viscosity refers to a measurement made by ASTM method D445.

GTL base stocks and base oils derived from GTL base stocks which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. In the present invention, however, the GTL base stock(s) used generally are those having pour points of about −30° C. or higher, preferably about −25° C. or higher, more preferably about −20° C. or higher. References herein to pour point refer to measurement made by ASTM D97 and similar automated versions.

The GTL base stock(s) derived from GTL materials, especially hydrodewaxed or hydroisomerized/cat (or solvent) dewaxed synthetic wax, especially F-T material derived base stock(s) are also characterized typically as having viscosity indices of 80 or greater, preferably 100 or greater, and more preferably 120 or greater. Additionally, in certain particular instances, the viscosity index of these base stocks may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270. GTL base stock(s) having a kinematic viscosity of at least about 3 $mm^2/s$ at 100° C. and a viscosity index of at least about 130 provide good results.

In addition, the GTL base stock(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and base oils typically have very low sulfur and nitrogen content, generally containing less than about 10 ppm, and more typically less than about 5 ppm of each of these elements. The sulfur and nitrogen content of GTL base stock(s) obtained by the hydroisomerization/isodewaxing of F-T material, especially F-T wax is essentially nil.

In a preferred embodiment, the GTL base stock(s) comprises paraffinic materials that consist predominantly of non-cyclic isoparaffins and only minor amounts of cycloparaffins. These GTL base stock(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins based on total GTL base stock composition.

Useful compositions of GTL base stock(s) are recited in U.S. Pat. Nos. 6,080,301; 6,090,989, and 6,165,949 for example, which are herein incorporated by reference.

In the present invention, mixtures of base stock(s), mixtures of the GTL base stock(s), or mixtures thereof, preferably mixtures of GTL base stock(s) provided each component in the mixture has been subjected to a different final wax processing technique, can constitute all or part of the base oil.

The base oil of the present invention may also comprise at least one co-base stock. Generally, co-base stock(s) are Group IV base stock(s). Co-base stock(s) that can be used include alkylated aromatic compounds. Examples of alkylated aromatic compounds include, but are not limited to, alkylated naphthalenes and polyesters such as di- or tri-esters.

The preferred base stocks or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL base stock is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) $BI-0.5(CH_{2>}4)>15$; and (b) $BI+0.85\ (CH_2 \geqq 4)<45$ as measured over said base stock.

The preferred GTL base stock can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred $BI \geqq 25.4$ and $(CH_2 \geqq 4) \leqq 22.5$. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula:

$$DV(\text{at } -40^\circ\text{ C.})<2900(KV \text{ at } 100^\circ\text{ C.})-7000.$$

The preferred GTL base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1 H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT 13C NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a. calculate the average carbon number of the molecules in the sample which is accomplished with sufficient accuracy for lubricating oil materials by simply dividing the molecular weight of the sample oil by 14 (the formula weight of $CH_2$);
b. divide the total carbon-13 integral area (chart divisions or area counts) by the average carbon number from step a. to obtain the integral area per carbon in the sample;
c. measure the area between 29.9 ppm and 29.6 ppm in the sample; and
d. divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-d1 were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stock(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The additives used in the present invention are high viscosity polyesters. They typically have a kinematic viscosity at 100° C. of at least about 2,500 $mm^2/s$, preferably at least about 3,000 $mm^2/s$. The VI of the additives is in the range of about 250-300, preferably about 300, as measured by ASTM D2270.

The additives used in the present invention are high viscosity polyesters having chemical structure I.

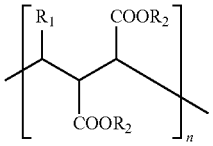

where $R_1$=$C_8$-$C_{20}$ $R_2$=$C_8$ n=3 to 14

For a molecular weight range between 2,000 and 6,000 and when $R_2$ is $C_8$(2-ethylhexyl) and $R_1$ is $C_4$ to $C_{12}$ (olefin part) or a four to twelve carbon number chain, n will range from 4 to 14.

Preferably, the high viscosity polyesters are co-polymers of alpha-olefins and alpha, beta unsaturated 1,4 dicarboxylic acid esters. Preferably, the alkyl group of the esters is 2 ethyl-hexyl. The preferred high viscosity polyesters employed in the present invention are commercially available from Akzo Nobel under the tradename Ketjenlube 23000.

The additives used in the present invention generally have an average molecular weight ranging from about 10,000 to about 20,000, preferably from about 12,000 to about 18,200, more preferably about 15,000.

Formulated lubricant compositions comprise a mixture of a base stock and/or a base oil and at least one performance additive. Usually, the base stock is a single oil secured from a single crude source and subjected to a single processing scheme and meeting a particular specification. Base oils comprise at least one base stock. Preferably, the base oils of the present invention are GTL base oils or PAO base oils. The base oils can be blends of GTL base oils and other base stocks and/or base oils such as PAOs. More preferably, the base oils are GTL base oils.

The lubricant compositions of the present invention comprise a major amount of at least one base oil and an effective amount of a high viscosity polyester additive. The at least one base oil constitutes the major component of the lubricating oil composition and typically is present in an amount ranging from about 50 wt. % to about 99 wt. %, e.g., from about 85 wt. % to about 95 wt. %, based on the total weight of the composition. By effective amount, it is meant that the high viscosity polyester additive is present in amounts ranging from about 1 wt. % to about 10 wt. %, preferably ranging from 2 wt. % to about 7 wt. %, of the total lubricant composition. Optionally, the additives of the present invention may be used in combination with other additives such as molybdenum dithiocarbamate, a known friction modifier additive.

The additives of the present invention can be used in, but not limited to, both straight grade and multigrade lubricating oil formulations for both gasoline and diesel (compression ignition) engines, natural gas engines, turbine engines, automatic and manual transmissions, marine diesel engines, gear boxes and other industrial lubricants formulated with highly saturated base oils.

The lubricating composition of the present invention may be formulated with one or more additional additives such as ashless dispersants, normal or overbased metal detergent(s), anti-wear additive, antioxidants, rust inhibitors, and defoamants.

Dispersants useful in this invention are borated and non-borated nitrogen-containing compounds that are oil soluble salts, amides, imides and esters made from high molecular weight mono and di-carboxylic acids and various amines. Preferred dispersants are the reaction of polyolefins ($C_2$-$C_5$ olefins), such as polyisobutenyl succinic anhydride with an alkoxy or alkylene polyamine such as tetraethylenepentamine. The borated dispersants contain boron in an amount from about 0.5 to 5.0 wt % based on dispersants. Dispersants are used generally in amounts from about 0.5 to about 10 wt % based on the total weight of the lubricating oil composition.

Detergents useful in the formulations include the normal, basic or overbased metal, that is calcium, magnesium and the like, salts of petroleum naphthenic acids, petroleum sulfonic acids, alkyl benzene sulfonic acids, alkyl phenols, alkylene bis-phenols, oil soluble fatty acids. The preferred detergents are the normal or overbased calcium or magnesium salicylates, carboxylates, sulfonates and or phenates. Detergents are used generally in amounts from about 0.5 to about 25 wt % more preferably from about 0.6 to about 6 wt % based on the total weight of the lubricating oil composition.

Examples of suitable antioxidants are hindered phenols, such as 2,6-di-tert-butylphenol, 4,4'-methylene bis(2,6-di-tert-butylphenol)2,6-di-tert-butyl-p-cresol and the like, amine antioxidants such as alkylated naphthylamines, alkylated diphenylamines and the like. Antioxidants are used generally in amounts from about 0.01 to about 3 wt % based on the total weight of the lubricating oil composition.

Anti-wear agents generally are oil-soluble zinc dihydrocarbyldithiophosphates having at least a total of 5 carbon atom, the alkyl group being preferably $C_2$-$C_8$. They are typically present in amounts of from about 0.01 to 5 wt %, preferably 0.4 to 1.5 wt % based on total weight of the lubricating oil composition.

Conventional viscosity index (VI) improvers that can also be used in addition to or in combination with the high viscosity polyester of this invention, are the olefin polymers such as polybutene, ethylene-propylene copolymers,hydrogenated polymers and copolymers and terpolymers of styrene with isoprene and/or butadiene, polymers of alkyl acrylates or alkyl methacrylates, copolymers of alkylmethacrylates with N-vinyl pyrrolidone or dimethylaminoalkyl methacrylate, post grafted polymers of ethylene-propylene with an active monomer such as maleic anhydride which may be further reacted with an alcohol or an alkylene polyamine, styrene-maleic anhydride polymers post-reacted with alcohols and amines and the like. These additives are used in amounts from about 1.5 to about 15 wt % based on total weight of the lubricating oil composition. The amounts also depend on the desired viscosity specifications.

Friction modifiers that can also be used in this invention comprise molybdenum dithiocarbamates. Examples of molybdenum dithiocarbamates include $C_6$- $C_{18}$ dialkyl or diaryldithiocarbamates, or alkylaryldithiocarbamates such as dibutyl, diamyl, diamyl-di-(2-ethylhexyl), dilauryl, dioleyl and dicyclohexyl dithiocarbamate. The amount of molybdenum dithiocarbamate(s) present in the oil, ranges from about 0.05 to about 1 wt % based on total weight of lubricating oil composition. The molybdenum content can range from about 20 to about 500 ppm, most preferably from about 50 to about 120 ppm.

Defoamants, typically silicone compounds such as polydimethylsiloxane polymers are commercially available and may be used in conventional minor amounts along with other additives such as demulsifiers; usually the amount of these additives combined is less than 1 wt % and often less than 0.2 wt % based on total weight of lubricating composition.

The foregoing additives are all commercially available materials. Indeed, these additives are usually not added independently but are precombined in packages which can be obtained from suppliers of lubricant oil additives. Additive packages with a variety of ingredients, proportions and characteristics are available and selection of the appropriate package will take the requisite use of the ultimate composition into account.

In preparing the lubricant compositions of the present invention, the additives of the present invention and, optionally, other additives are added to and mixed with a base oil to make up a substantially homogeneous mixture. Preferably, the base oil is a GTL base oil.

The following non-limiting examples are provided to illustrate the invention.

EXAMPLE 1

A series of lubricant compositions were formulated and evaluated for friction reducing properties using a GTL base oil. The GTL base oil used had a kinematic viscosity at 100° C. of about 3.6 $mm^2/s$. The additive used was a high viscosity polyester, Ketjenlube 23000, having a kinematic viscosity at 100° C. of about 3,000 $mm^2/s$. Ketjenlube 23000 was compared with commercially available additives at varying treat rates: Indopol H-1500, a polyisobutylene (PIB) VI improver, and Perfad FM 3336, a friction modifier additive. Perfad FM 3336 has a kinematic viscosity at 100° C. of about 13 $mm^2/s$. Additionally, LZ 7720c, a polyester known to improve VI was used to show that not all polyesters provide good friction reducing properties. LZ 7720c has a kinematic viscosity at 100° C. of about 500 $mm^2/S$.

The friction coefficient was measured using a High Frequency Reciprocating Rig (HFRR), commercially available from PCS Instruments. The HFRR test method measures the lubricity, or ability of a fluid to affect friction between surfaces in relative motion under a load. The factors considered in determining lubricity are friction coefficient, film thickness and scar average. The test method used was based on a modification of ASTM D6079. ASTM D6079 is incorporated herein by reference. The modified test method used is as follows. A 2-mL test specimen of fuel was placed in the test reservoir of an HFRR. The temperature of the specimen was increased from 30° C. to 160° C. at a rate of 2° C./minute. When the specimen temperature was stabilized at 160° C., a vibrator arm holding a non-rotating steel ball and loaded with 400-g mass was lowered until it contacted a test disk completely submerged in the specimen. The ball was caused to rub against the disk with a 1-mm stroke at a frequency of 60 Hz for 75 minutes.

As can be seen from Table 1, treating the GTL base oil with Indopol H-1500, a VI improver, at a treat rate of 2 wt. %, did not form much of a film. This shows that Indopol H-1500 does not behave as a friction modifier. As a result, the friction coefficient was relatively high ranging from 0.15-0.22. Suprisingly, using Ketjenlube 23000, at the same treat rate, provided the base oil with a very low friction coefficient ranging from 0.028-0.059. Compared to a known friction modifier additive, Perfad FM 3336, at a treat rate of 2 wt. %, Ketjenlube 23000 gave similar film thickness but lower friction coefficient. Ketjenlube 23000 provided excellent film thickness and lower friction coefficient when blended with a GTL base oil.

TABLE 1

| | Fluid 1 | Fluid 2 | Fluid 3 | Fluid 4 | Fluid 5 |
|---|---|---|---|---|---|
| GTL 3.6, wt % | 98.0 | 98.0 | 98.0 | 98.0 | 90.0 |
| Ketjenlube 23000, wt % | 2.0 | | | | 10.0 |
| Indopol H-1500, wt % | | 2.0 | | | |

TABLE 1-continued

| | Fluid 1 | Fluid 2 | Fluid 3 | Fluid 4 | Fluid 5 |
|---|---|---|---|---|---|
| Perfad FM 3336, wt % | | | 2.0 | | |
| LZ 7720c, wt % | | | | 2.0 | |
| HFRR Temperature, ° C. | Friction Coefficient | Friction Coefficient | Friction Coefficient | Friction Coefficient | Friction Coefficient |
| 60 | 0.059 | 0.153 | 0.071 | 0.126 | 0.098 |
| 70 | 0.051 | 0.168 | 0.072 | 0.128 | 0.095 |
| 80 | 0.053 | 0.172 | 0.079 | 0.122 | 0.071 |
| 90 | 0.048 | 0.180 | 0.079 | 0.129 | 0.055 |
| 100 | 0.042 | 0.200 | 0.075 | 0.132 | 0.044 |
| 110 | 0.031 | 0.227 | 0.069 | 0.143 | 0.037 |
| 120 | 0.028 | 0.208 | 0.046 | 0.136 | 0.040 |
| 130 | 0.029 | 0.223 | 0.048 | 0.143 | 0.033 |
| 140 | 0.025 | 0.210 | 0.046 | 0.132 | 0.036 |
| 150 | 0.040 | 0.203 | 0.043 | 0.133 | 0.032 |
| 160 | 0.039 | 0.212 | 0.065 | 0.137 | 0.049 |
| Average film % | 76.4 | 5.2 | 74.4 | 34.9 | 71.2 |
| Average Scar, μm | 239 | 429 | 138 | 329 | 257 |

EXAMPLE 2

As can be seen in Table 2, the VI of the lubricant composition significantly improved with the additive treat rate. The VI was calculated from the kinematic viscosity (KV) at 40° C. and 100° C. using ASTM D 2270, which is herein incorporated by reference.

TABLE 2

| | Fluid 7 | Fluid 8 | Fluid 9 | Fluid 10 |
|---|---|---|---|---|
| GTL 3.6, wt % | 100.0 | 98.0 | 95.0 | 90.0 |
| Ketjenlube 23000 | 0 | 2.0 | 5.0 | 10.0 |
| KV @ 40° C., $mm^2/S$ | 14.68 | 15.87 | 17.88 | 220.0 |
| KV @ 100° C., $mm^2/S$ | 3.65 | 3.92 | 4.34 | 5.19 |
| VI | 138 | 148 | 159 | 179 |

EXAMPLE 3

Table 3 illustrates the solvency properties, as measured by the aniline point, of the high viscosity polyester-GTL blends as compared with those of PIB-GTL blends. Solvency is measured by the aniline point as measured according to ASTM D611, which is incorporated herein by reference. Lower aniline point translates to better solvency. As shown in Table 3, PIB increased the aniline point of the mixture, whereas Ketjenlube 23000 did not. The aniline point of the lubricant composition remained relatively constant with increased Ketjenlube 23000 treat rate. However, the aniline point increased with increased PIB treat rate.

TABLE 3

| | Fluid 11 | Fluid 12 | Fluid 13 | Fluid 14 | Fluid 15 | Fluid 16 | Fluid 17 |
|---|---|---|---|---|---|---|---|
| GTL 3.6, wt % | 100 | 98.0 | 98.0 | 95.0 | 95.0 | 90.0 | 90.0 |
| Indopol H-1500, wt % | 0 | 2.0 | 0 | 5.0 | 0 | 10.0 | 0 |
| Ketjenlube 23000, wt % | 0 | 0 | 2.0 | 0 | 5.0 | 0 | 10.0 |
| Aniline Point, ° C. | 119.2 | 120.3 | 119.3 | 121.4 | 119.4 | 124.5 | 119.7 |

The additives of the present invention not only provide a lubricant composition with a reduced friction coefficient and improved viscosity index but the additives also advantageously improve the solvency of lubricant compositions.

It will thus be seen that the objects set forth above, among those apparent in the preceding description, are efficiently attained and, since certain changes may be made in carrying out the present invention without departing from the spirit and scope of the invention, it is intended that all matter contained in the above description and shown in the accompanying drawing be interpreted as illustrative and not in a limiting sense.

It is also understood that the following claims are intended to cover all of the generic and specific features of the invention herein described and all statements of the scope of the invention, which as a matter of language, might be said to fall therebetween.

What is claimed is:

1. A lubricant composition comprising a major amount of at least one base oil and a high viscosity polyester additive, wherein said high viscosity polyester additive is a co-polymer of alpha-olefins and alpha, beta unsaturated 1,4 dicarboxylic acid esters having an average molecular weight ranging from about 10,000 to about 20,000 and having a kinematic viscosity at 100° C. of at least about 2,500 $mm^2/s$, said additive being present in an amount ranging from about 1 wt % to about 10 wt % of the total composition.

2. The composition of claim 1, wherein the composition comprises about 50 wt. % to about 99 wt. % of said at least one base oil.

3. The composition of claim 2, wherein said at least one base oil is a GTL base oil.

4. The composition of claim 2, wherein said at least one base oil is a PAO base oil.

5. The composition of any of claims 3, 4, and 2, wherein said high viscosity polyester additive has a kinematic viscosity at 100° C. of at least about 3,000 $mm^2/s$.

6. The composition of claim 5, wherein said esters contain 2-ethylhexyl as an alkyl group.

7. A method for improving frictional properties in a lubricant composition comprising adding to the composition comprising at least one base oil a high viscosity polyester additive in an amount ranging from about 1 wt. % to about 10 wt. % of the total composition wherein said polyester additive is a co-polymer of alpha-olefins and alpha, beta unsaturated 1,4 dicarboxylic acid esters having a kinematic viscosity at 100° C. of 2,500 $mm^2/s$ and an average molecular weight ranging from about 10,000 to about 20,000.

8. The method of claim 7, wherein the composition comprises about 50 wt. % to about 99 wt. % of said at least one base oil.

9. The method of claim 8, wherein said at least one base oil is a GTL base oil.

10. The method of claim 8, wherein said at least one base oil is a PAO base oil.

11. The method of claim 9 or 10, wherein said high viscosity polyester additive has a kinematic viscosity at 100° C. of at least about 3,000 $mm^2/s$.

12. A method of providing friction reducing properties and viscosity index and solvency improving properties in a lubricant system using the composition of claim 1.

13. The method of claim 11 wherein said esters contain 2-ethylhexyl as an alkyl group.

* * * * *